United States Patent [19]

Crone et al.

[11] Patent Number: 4,785,994

[45] Date of Patent: Nov. 22, 1988

[54] SLIDING JOINT FOR WELDED RAIL SECTIONS

[76] Inventors: Walter G. Crone, 1599 Vinton Ave., Memphis, Tenn. 38104; Harry B. Cundiff, No. 1 George Wythe Pl., Atlanta, Ga. 30318

[21] Appl. No.: 72,599

[22] Filed: Jul. 13, 1987

[51] Int. Cl.[4] ..... E01B 11/00

[52] U.S. Cl. ..... 238/171; 238/165

[58] Field of Search ..... 238/171, 165

[56] References Cited

U.S. PATENT DOCUMENTS

| | | | |
|---|---|---|---|
| 411,362 | 9/1889 | Weir | 238/171 |
| 2,067,598 | 1/1937 | Clarke | 238/171 |
| 2,067,695 | 1/1937 | Conley | 238/171 |
| 3,008,644 | 11/1961 | Wagner | 238/171 |

*Primary Examiner*—A. Michael Chambers

*Attorney, Agent, or Firm*—John E. Reilly

[57] ABSTRACT

A sliding joint of the type designed to permit expansion and contraction between adjoining ends of rail sections in a single or double track system is characterized by having a rail point defining an extension of one adjoining end which is both lengthened and reinforced along the area adjacent to its juncture with the one adjoining end to more effectively absorb and distribute stresses imparted under wheel loading. A limit stop for the curved end of the rail section is mounted on the base of the joint ahead of the juncture of the rail point with the one adjoining end of the rail so as to further alleviate stresses imparted by the curved rail to the rail point when the curved rail undergoes maximum expansion.

9 Claims, 2 Drawing Sheets

SLIDING JOINT FOR WELDED RAIL SECTIONS

This invention relates to sliding joints; and more particularly relates to a novel and improved sliding joint for interconnection of rail sections in a railway track system.

BACKGROUND AND FIELD OF THE INVENTION

It is customary to employ sliding joints in the rail sections along a track so as to afford some means of expansion and contraction of the rails in response to temperature changes but at the same time permit smooth transfer of a train or other railway vehicle from section to section. Typically, such sliding joints are employed on curves, trestles and approaches to bridges.

The present invention is concerned in particular with that form of sliding joint disclosed in U.S. Pat. No. 3,008,644 to C. O. Wagner and assigned to the assignee of this application. In accordance with the teachings of that patent, the joint is an integral casting constituted of a base flange underlying adjacent ends of the rail sections to be joined, there being a rail point tapering forwardly from one adjacent end of a rail section with one side thereof forming a tapered bearing surface; and the other adjacent end of the rail section is in the form of a curved rail extending along the bearing surface and curving laterally away from the gauge line of the track. The basic concept of this sliding joint construction has been found to be highly effective and durable in use. Nevertheless, in certain applications it is desirable to increase the strength and durability of the joint particularly along that section between the rail point and its connection to one of the rail sections and in such a way as to establish additional bearing surface on the ties and distribute the wheel load more advantageously. Moreover, the practice in the past has been to place a stop member along one side of the rail point to limit the expansion of the wing rail. It has been found to be more advantageous and effective to remove the stop member from the rail point and locate it on the base of the casting so as to transfer longitudinal forces resulting from extreme temperature expansion of the track rail directly into the base of the casting while increasing the strength and durability of the rail point along that section in a novel and improved manner to be hereinafter described.

SUMMARY OF THE INVENTION

Accordingly, it is an object of the present invention to provide for a novel and improved sliding joint for use in track systems for railways.

Another object of the present invention is to provide for a novel and improved sliding joint which can be constructed as an integral casting to underlie adjacent ends of rail sections to be joined in such a way as to efficiently distribute wheel loads and alleviate stress at critical areas along the joint.

It is a further object of the present invention to provide for a novel and improved sliding joint for rail sections which is so constructed and arranged as to most efficiently absorb and distribute stresses imparted under wheel loading and further combined with a novel and improved form of stop member for limiting expansion of the rail sections within predetermined limits designed into the rail joint.

In accordance with the present invention, there has been devised a sliding joint of the type having a continuous base member underlying adjacent ends of a pair of longitudinally extending rail sections with a rail point extending from one of the rail sections toward the other and including a tapered bearing surface along one side for slidable movement of the other curved rail section in response to expansion and contraction of the rail. A novel and improved rail point includes a reinforcing web in the form of an inner spaced wall which projects beyond its surface of engagement with the one rail section toward its tapered end or tip to reinforce the rail point along its greater length, and an external reinforcing rib extends continuously along the external surface of the point coextensive with the inner wall. Additionally, the limit stop for the other curved end of the rail section is removed from the rail point and incorporated into the base of the joint at a location to effectively resist lengthwise expansion of the rail sections beyond predetermined limits.

The above and other objects of the present invention will become more readily appreciated and understood from a consideration of the following detailed description of a preferred embodiment when taken together with the accompanying drawings wherein:

DETAILED DESCRIPTION OF THE PREFERRED EMBODIMENT

Figures 1, 2, 3, 4:
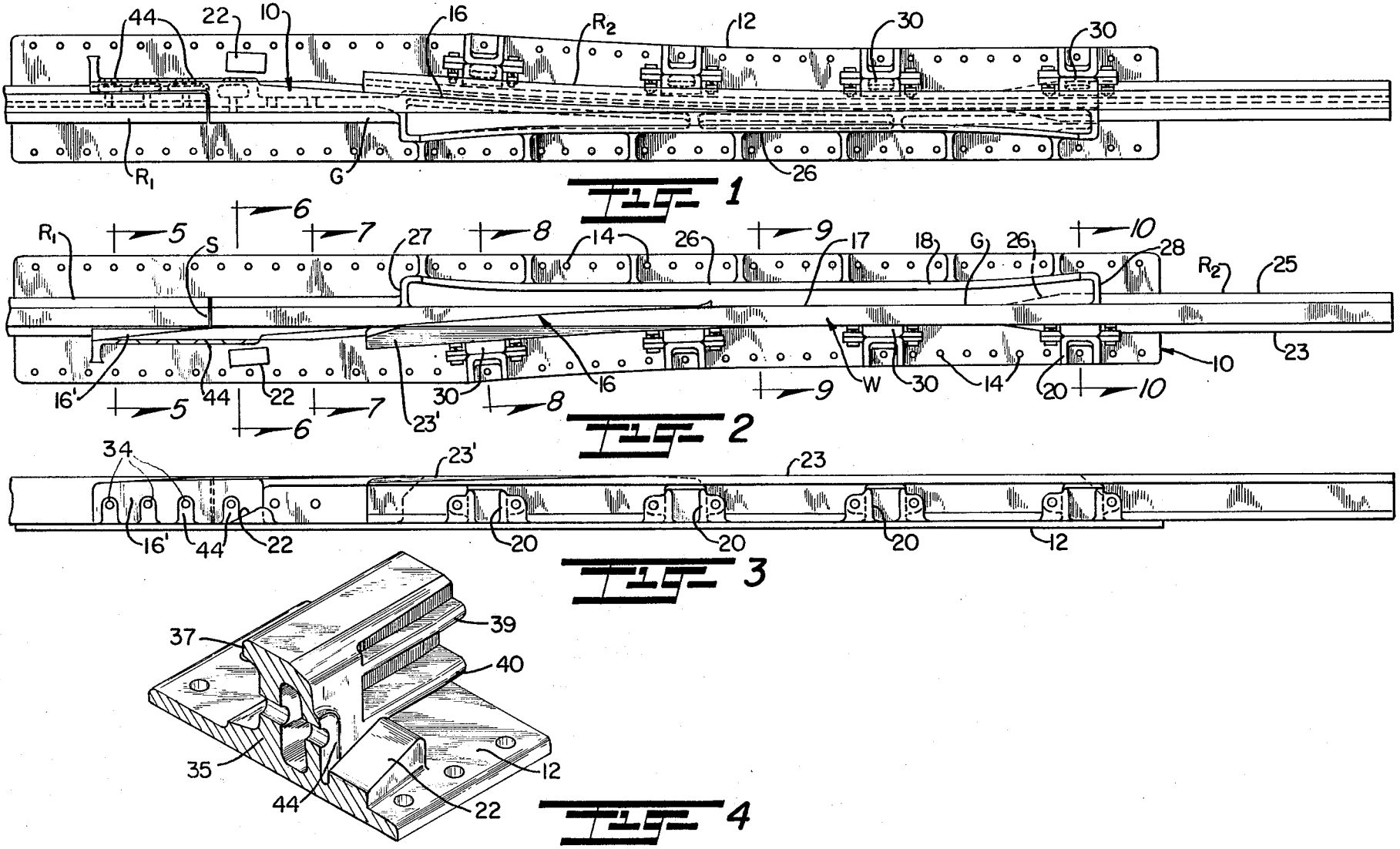
FIG. 1 is a top plan view of a preferred form of sliding joint in accordance with the present invention for a multiple track system.
FIG. 2 is a top plan view of the preferred form of sliding joint for the other of a pair of parallel track systems in accordance with the present invention.
FIG. 3 is a side view in elevation of the preferred form of sliding joint illustrated in FIG. 2.
FIG. 4 is a somewhat perspective fragmentary view of a preferred rail point forming a part of the sliding joint illustrated in FIGS. 1 to 3.

As a preliminary to a description of the salient features of the present invention, the preferred form of sliding joint 10 is illustrated in the drawings for use in joining standard welded rail sections, such as, rail sections $R_1$ and $R_2$, in a double track system. Specifically, the rail sections $R_1$ and $R_2$ are welded together into extended lengths at the factory and transported to the intended site of use. It will be noted that one of the rail sections $R_1$ terminates in a straight end section S while the other of the rail sections $R_2$ terminates in an elongated curved end, customarily referred to as a wing rail W. In this regard, the wing rail W is curved along a predetermined line of divergence away from the gauge line designated at G, the gauge line G being an imaginary line extending along the upper side surface of the straight rail sections. In order to effect smooth transfer of the wheel load between adjacent ends of the rail sections, it will be appreciated that the sliding joint 10 establishes virtually an uninterrupted continuation of the gauge line while effectively absorbing or withstanding extreme forces imparted by the wheels of a train or other railway vehicles. Although not shown, the rail sections are conventionally mounted on ties at spaced intervals along the track system. Broadly, the sliding joint 10 includes a base member or flange 12 which is secured also to underlying ties, not shown, by suitable fasteners extending through selected of the spaced openings 14 along either side of the base flange 12, the base flange being mounted such that its upper surface will support the adjacent ends S and W of the rail sections $R_1$ and $R_2$.

Projecting upwardly from the base flange 12 is a novel and improved form of rail point 16 terminating in a leading end or tip 17, and a conventional form of guard 18 also projects upwardly from the base flange 12 along the greater length of the joint; and further, conventional support members 20 project upwardly from the base flange 12 at longitudinally spaced intervals along one side of the base opposite to the guard member 18. A stop member 22 projects upwardly from the base at a location laterally spaced from the point 16 adjacent to the terminal end S of the rail section $R_1$. Preferably, the base flange 12, rail point 16, guard 18, support members 20 and stop 22 are in the form of an integral casting o a high strength metal composition, such as, manganese steel. FIGS. 1 and 2 generally denote opposite hands of a two-rail track system and like parts are correspondingly enumerated in the drawings. In this relation, the rail sections $R_1$ and $R_2$ may be standard T-rails which, as best seen from FIGS. 5 and 7 to 10, comprise an enlarged head 23, intermediate web 24 and lower flange 25. Moreover, from a consideration of FIGS. 2 and 10, the lower flange 25 of rail section $R_2$ tapers forwardly along section 26 from a relatively wide flange to a narrow width corresponding to that of the rail head 23 at its point of divergence or curvature into the wing rail W. The wing rail W is dimensioned to curve along the greater length of the rail point to form leading end or tip 17 of the point 16 to a point of maximum expansion defined by the limit stop 22. As seen from FIG. 8, the rail W terminates in a generally I-shaped cross-section, in which the head 23 has a beveled surface 23' sloping in a direction away from the point 16 and toward the support members 20 so as to avoid interference with free rolling movement of the wheel along the sliding joint. The rail section $R_1$ is of uniform cross-section and terminates in a squared end at its rail end S; i.e., the juncture or point of abutment with the rail point 16.

The guard rail 18 and support members 20 are of conventional construction and correspond with the form of sliding joint assembly disclosed in the aforementioned U.S. Pat. No. 3,008,644, and accordingly a brief description will suffice. The guard 18 includes an upstanding wall portion 26 which slopes downwardly at opposite ends into end walls 27 and 28, the end wall 27 extending transversely of the length of the joint into contact with one side of the rail point 16, and the opposite end wall 28 extends parallel to the end wall 27 into contact with one side of the rail $R_2$. The cross-sectional configuration of the guard is illustrated in FIGS. 7 to 10, inclusive, and broadly functions to prevent impact of the wheel rims against the rail point and to prevent undue shifting of the wheels in advancing across the joint. The support members 20 are spaced along the opposite side of the base flange 12 to that of the guard 18 and include filler blocks 30 inserted between the support members 20 and the side of the wing rail W so as to support the wing ail in fixed position against the side of the rail point 16. Generally, the supporting members 20 are located with one member 20 positioned opposite the rail W adjacent to its terminal end, another spaced opposite the tip 17 of the rail point, and third and fourth members 20 are evenly spaced toward the end of the base flange which supports the rail section $R_2$.

An important feature of the present invention resides in the construction of the rail point 16 and the disposition of the limit stop/22 on the base flange 12 at a location which will limit expansion of the rail W at a point ahead of the junction of the rail end S and the rail point 16. The former practice, as typified by the hereinbefore referred to U.S. Pat. No. 3,008,644, has been to position the stop member on the side of the rail point casting immediately adjacent to the rail end S so that, under extreme expansion of the wing rail W, there was a tendency to place undue stress on the rail point which led to cracks and breakage under heavy traffic. A contributing factor was the apparent inability to strengthen the rail point at its juncture with the rail end S or, in other words, at the point of maximum expansion.

Figure 5:
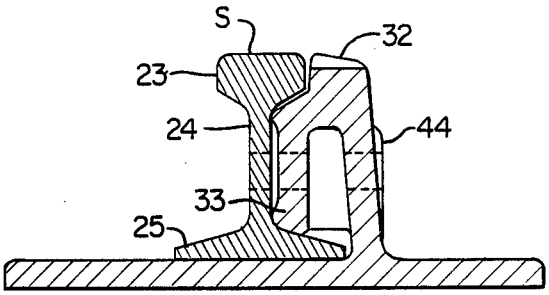
FIG. 5 is a cross-sectional view taken about lines 5—5 of FIG. 2.
Figure 6:
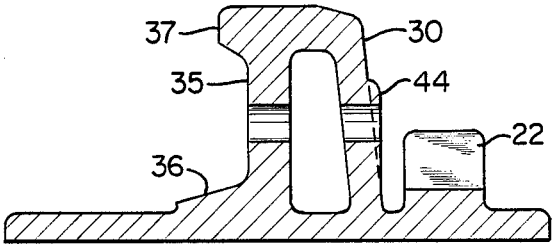
FIG. 6 is a cross-sectional view taken about lines 6—6 of FIG. 2.
Figure 7:
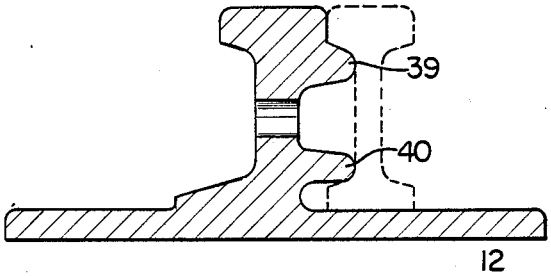
FIG. 7 is a cross-sectional view taken about lines 7—7 of FIG. 2.

Referring in more detail to FIGS. 4 to 7, the rail point 16 includes a rearward extension 16', an outer upstanding wall portion 31 directed upwardly from the base 12 into a rearwardly sloped upper surface 32 and continuing inwardly into a downwardly directed leg portion 33, the latter bearing against the side of the rail end S. The extension 16' is connected to the rail end S by suitable fasteners, such as, bolts extending laterally through openings 34 in the extension 16' and rail end S, as illustrated in FIGS. 3 and 5. In progressing forwardly toward the tapered leading end or tip 17 of the rail point 16, the inner leg 33 merges into an upstanding wall portion 35 which is spaced inwardly from the wall portion 31 and extends upwardly from the base flange 36 to terminate in a thick-walled upper flange 37. Flange 37 is joined into the outer wall 31 and its upper surface forms a broadened continuation of the upper surface 32. The upstanding wall 35 and its upper flange 37 effectively form a continuation of the rail end S into the end wall 27 of the guard member 18. However, the outer wall 31 continues but for a limited distance, as shown in FIG. 4, forwardly beyond the rail end S to a point adjacent to the leading end of the stop 22 and then converges into upper and lower lateral projections 39 and 40 on the wall portion 35.

Figure 8:
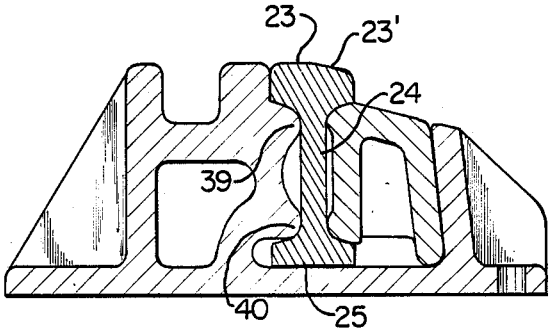
FIG. 8 is a cross-sectional view taken about lines 8—8 of FIG. 2.
Figure 9:
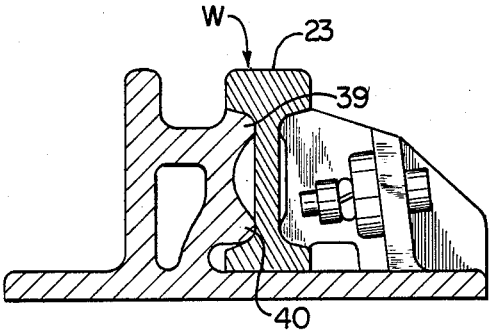
FIG. 9 is a cross-sectional view taken about lines 9—9 of FIG. 2.
Figure 10:
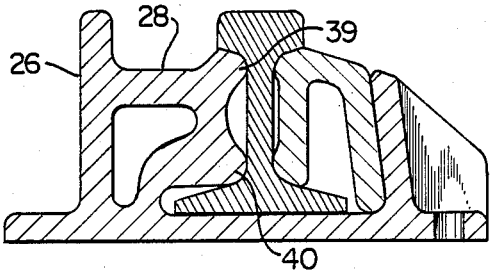
FIG. 10 is a cross-sectional view taken about lines 10—10 of FIG. 2.

The upper and lower projections 39 and 40 define inclined bearing surfaces for engagement with the wing rail W along the remaining length of the rail point into the tip 17 where the bearing portions merge into the guard 18 for continued forward extension along the guard and to finally terminate at the end wall 28 of the guard, as illustrated in FIGS. 8 to 10. Accordingly, the upper and lower projections 39 and 40 define the principal bearing surfaces for the wing rail W in guiding it along a predetermined line of divergence away from the gauge line G with the upper projection 39 engaging the web 24 and underside of the head 23 of the wing rail W, and the lower projection 40 engaging the web 24 at its intersection with the lower flange 25. In order to serve as additional reinforcement along the outer wall 31 of the rail point 16, the wall thickness is increased around the openings 34 by formation of ribs 44 protruding laterally from the wall 31 toward the stop member 22, each rib 44 surrounding an opening 34 from the stop 22 into the rearward terminal end of the rail point alongside of the rail end S.

The overall casting length of the sliding joint is increased, in comparison to that of the joint illustrated and disclosed in aforementioned U.S. Pat. No. 3,008,644. Specifically, the increased length is along the rail point 16 of the casting just forwardly of its juncture with the rail end S. In this way, the stop member 22 can be positioned forwardly of the rail end S and yet allow for the necessary expansion of the wing rail W along the inclined bearing surfaces 39 and 40 of the rail point 16. The stop member 22 will effectively transfer any longitudinally applied forces resulting from extreme expansion of the track rail from the upper portion of the casting to the base flange 12 thereby minimizing any cracking or breakage problems in the rail point itself. To this end, the stop 22 is in the form of a generally triangular abutment which is aligned in parallel with and in the path of expansion of the wing rail W. The stop is formed with an upstanding abutment wall 50 at its leading end which, as described earlier, is located just forwardly of and alongside the intersection of the outer wall 31 of the rail point 16 and the upper and lower bearing surfaces or projections 39 and 40. Preferably, the stop member 22 is relatively low profile and, in the preferred form, is of a height less than one-half the height of the wing rail W.

From the foregoing, it will be evident that the wing rail W is free to slide along the stationary rail point 16 as a result of any expansion or contraction in the rail W due to temperature changes. Notwithstanding any expansion or contraction of the wing rail, the gauge line G is maintained constant between the rail sections $R_1$ and $R_2$ by virtue of the forward tapering of the rail point into the tip end 17 at the line of divergence of the wing rail away from the gauge line. By limiting the expansion of the wing rail W and accordingly the inclined bearing surfaces 39 and 40 to a point, as defined by stop member 22, ahead of the juncture of the rail point 16 and the rail end S, the effective width and wall thickness of the point 16 can be increased along the entire area or section rearwardly of the stop thereby greatly strengthening the point and minimizing any danger of cracking at its juncture with the rail end S.

It is therefore to be understood that various modifications and changes may be made in the construction and arrangement of elements of the sliding joint as well as the application and use of the joint to various track assistance without departing from the spirit and scope of the present invention as defined by the appended claims.

We claim:

1. In a sliding joint having a continuous base member underlying adjacent ends of a pair of longitudinally extending rail sections wherein a rail point extends from one of said adjacent ends in a direction toward the other of said adjacent ends, the other of said adjacent ends defined by a wing rail, said rail point including a bearing portion along one side thereof for slidable movement of said wing rail along said bearing portion in response to expansion and contraction of said rail sections, the improvement comprising:

a limit stop member on said sliding joint at a location adjacent to the juncture of said one adjacent end and said rail point whereby to limit slidable movement of said wing rail along said bearing portion of said rail point; and said rail point including a reinforcing wall extending fowardly from one of said adjacent ends toward the other of said adjacent ends of said rail sections, said reinforcing wall spaced laterally of said bearing portion on a side opposite to said wing rail.

2. In a sliding joint according to claim 1, said stop member being integrally cast in unitary relation to said base member and projecting upwardly from said base member in spaced parallel relation to said rail point.

3. In a sliding joint according to claim 1, said stop member being in the form of an upwardly projecting block of a height less than the height of said rail point, said block being generally triangular in cross-sectional configuration and elongated in the direction of extension of said rail point.

4. In a sliding joint according to claim 1, said reinforcing wall having a rearward continuation extending along one side of said one adjacent end of said rail section in the form of a downwardly directed leg having a lower terminal end spaced above said base flange.

5. In a sliding joint according to claim 1, including a reinforcing rib projecting laterally from said rail point in a direction toward said stop member, said reinforcing rib forming a rearward continuation of said bearing portion on said rail point.

6. In a sliding joint having a continuous base member underlying adjacent ends of a pair of longitudinally extending rail sections, a rail point extending from one of said adjacent ends in a direction toward the other of said adjacent ends, the other of said adjacent ends defined by a wing rail, said rail point including tapered bearing portions along one side thereof for slidable movement of said wing rail along said bearing portions in response to expansion and contraction of said rail sections, the improvement comprising:

a limit stop member on said base member at a location adjacent to the juncture of said one adjacent end and said rail point whereby to limit slidable movement of said wing rail along said rail point; and said rail point including a reinforcing wall extending forwardly from one of said adjacent ends toward the other of said adjacent ends of said rail sections, said reinforcing wall spaced laterally of said bearing portions and extending upwardly from said base member, said reinforcing wall having a rearward continuation extending along one side of said one adjacent end of said rail section in the form of a downwardly direction leg having a lower terminal end spaced above said base member.

7. In a sliding joint according to claim 6, said stop member and said reinforcing wall integrally cast in unitary relation to said base member and projecting upwardly from said base member.

8. In a sliding joint according to claim 7, said stop member being in the form of an upwardly projecting block of a height less than the height of said rail point extending parallel to the direction of extension of said rail point.

9. In a sliding joint according to claim 6, including a reinforcing rib projecting laterally from said rail point in a direction toward said stop member, said reinforcing rib forming a rearward continuation of said bearing surface on said rail point.

* * * * *